US010549136B2

(12) United States Patent
Hsiang

(10) Patent No.: US 10,549,136 B2
(45) Date of Patent: Feb. 4, 2020

(54) TRAMPOLINE SUPPORT STRUCTURE

(71) Applicant: Crowntec (Jiang Xi) Sports Technology Co. Ltd., Jiujiang, Jiangxi Province (CN)

(72) Inventor: Hua-Lu Hsiang, Taoyuan (TW)

(73) Assignee: CROWNTEC (JIANG XI) SPORTS TECHNOLOGY CO., LTD., Jiujiang, Jiangxi Province (CN)

( * ) Notice: Subject to any disclaimer, the term of this patent is extended or adjusted under 35 U.S.C. 154(b) by 0 days.

(21) Appl. No.: 15/790,497

(22) Filed: Oct. 23, 2017

(65) Prior Publication Data

US 2018/0071564 A1 Mar. 15, 2018

(51) Int. Cl.

| | |
|---|---|
| ***A63B 5/11*** | (2006.01) |
| ***A63B 21/02*** | (2006.01) |
| ***A63B 71/00*** | (2006.01) |
| ***A63B 71/02*** | (2006.01) |

(52) U.S. Cl.

CPC ..... *A63B 5/11* (2013.01); *A63B 71/0054* (2013.01); *A63B 71/022* (2013.01); *A63B 21/023* (2013.01); *A63B 2071/009* (2013.01); *A63B 2210/50* (2013.01)

(58) Field of Classification Search

CPC ..... A63B 5/11; F16L 41/02; F16L 41/021

See application file for complete search history.

(56) References Cited

U.S. PATENT DOCUMENTS

2005/0143225 A1* 6/2005 Adams ..... A63B 5/11 482/27
2006/0189441 A1* 8/2006 VanElverdinghe ..... A63B 5/11 482/27
2009/0023558 A1* 1/2009 VanElverdinghe .. A63B 71/022 482/29
2010/0240496 A1* 9/2010 Chen ..... A63B 5/11 482/27
2012/0289379 A1* 11/2012 Stokes ..... A63B 5/11 482/27
2016/0030794 A1* 2/2016 Yang ..... A63B 5/11 482/27
2017/0326399 A1* 11/2017 Woodman ..... A63B 5/11

FOREIGN PATENT DOCUMENTS

| | | |
|---|---|---|
| CN | 2930768 Y | 8/2007 |
| CN | 201250829 Y | 6/2009 |
| CN | 201482040 U | 5/2010 |

* cited by examiner

*Primary Examiner* — Nyca T Nguyen

(74) *Attorney, Agent, or Firm* — Muncy, Geissler, Olds & Lowe, P.C.

(57) ABSTRACT

A trampoline support structure comprises a joining pipe including a longitudinal mounting hole and two transverse mounting portions, a first annular pipe including a first fitting segment and a first connecting segment, a second annular pipe including a second fitting segment and a second connecting segment, and a supporting pipe including a third fitting segment, in which the first annular pipe and the second annular pipe are mounted to the two transverse mounting portions of the joining pipe through the first fitting segment and the second fitting segment, respectively, while the supporting pipe is mounted to the longitudinal mounting hole of the joining pipe through the third fitting segment. In this case, the joining pipe is a linear tubular part so as to enable material cost savings with enhanced efficiency of assembly.

7 Claims, 8 Drawing Sheets

TRAMPOLINE SUPPORT STRUCTURE

FIELD OF THE INVENTION

The present invention is related to a trampoline support structure, particularly to a trampoline support structure allowed for not only saving material cost, but also simplifying assembling process with enhanced efficiency of assembly.

BACKGROUND OF THE INVENTION

Accordingly, a current trampoline is provided with a trampoline frame for supporting a bouncing net, the trampoline frame being composed of a plurality of supporting devices fitted together. A bounce bed is, as disclosed in Chinese patent publication no. CN2930768, characterized by a T-shaped three-way transverse pipe used as a connecting part to connect with a frame of bounce bed and a leg of bounce bed; sidewalls of the T-shaped three-way transverse pipe being openly provided with a radially locating through hole; a top surface of the T-shaped three-way transverse pipe being openly provided with an insertion hole for protective barrier; each segment of frame pipe of bounce bed being openly provided on each of top and bottom surfaces at each of both ends thereof with an insertion hole for protective barrier; two frame pipes of bounce bed respectively inserted from both ends of the T-shaped three-way transverse pipe being insertedly connected together such that the axes of two insertion holes for protective barrier of each frame pipe of bounce bed and the axis of the insertion hole for protective barrier of the transverse pipe coincide with each other, while locating through holes of two frame pipes of bounce bed and the locating through hole of the T-shaped three-way transverse pipe coincide with each other; the lower end of a protective barrier pipe being inserted into the insertion hole for protective barrier on the top surface of the T-shaped three-way transverse pipe and into the insertion holes for protective barrier at the inserted end of each of the two frame pipes of bounce bed inside the transverse pipe; a locating through hole of the protective barrier pipe and the locating through hole of the transverse pipe coinciding with each other and being fixed by a bolt penetrated therethrough. The connecting structure between the support frame and the protective barrier of the bouncing bed is simple and reliable, with decreased number of connecting parts, material savings, reduced cost, as well as convenient and fast assembly/disassembly.

Further, as disclosed in Chinese patent publication no. CN201482040, a cross connecting part for a bounce bed comprises a transverse pipe, an upper vertical pipe connected with an upper end surface of the transverse pipe, and a lower vertical pipe connected with a lower end surface of the transverse pipe, said upper and lower vertical pipes being integrally formed by die casting. The cross connecting part is simple in structure and easy to manufacture. During installation, the transverse pipe is used for installing a frame ring of bounce bed, the upper vertical pipe is used for installing a safety net pipe, and the lower vertical pipe is used for installing a leg of bounce bed, so as to facilitate the installation of each supporting component of the bounce bed.

Additionally, as disclosed in Chinese patent publication no. CN201250829, a frame pipe connecting structure of a trampoline comprises a frame pipe, a leg pipe, a protective barrier pipe and a four-way part for connection. The four-way part is composed of a vertical pipe and a transverse pipe welded at the upper end of the vertical pipe. The leg pipe is allowed to penetrate into the vertical pipe longitudinally. The transverse pipe is bored vertically. The large end of the frame pipe is extended into the transverse pipe to be reinforced by a reinforcing pipe inside the bore, and the small end of the frame pipe is extended into the transverse pipe while is coveringly connected together. The protective barrier pipe is inserted into the reinforcing pipe vertically and reinforced by a screw. This structure is allowed for not only faster and better assembly, but also convenient transportation and storage after disassembly. Moreover, the combined strength may be enhanced effectively, without being apt to sway, skid or damage the combined portion.

In all of the above patents, however, a T-shaped connecting part or cross-shaped connecting part is used for the connection of frame pipes and leg pipes. Moreover, in the most case of the T-shaped connecting part or cross-shaped connecting part, two tubular parts are joined by processing, such as welding, for example, after the two tubular parts are provided perpendicularly to each other. Thus, not only burden cost, but also difficulty in processing are resulted. Additionally, insufficient strength between the two tubular parts is, possibly due to insecurely welding at the welding point, possible for the occurrence of breakage.

SUMMARY OF THE INVENTION

Therefore, it is the main object of the present invention to provide a trampoline support structure allowed for not only saving material cost, but also simplifying assembling process with enhanced efficiency of assembly.

For achieving the above object, the present invention provides a trampoline support structure used for constituting a trampoline frame, on which a bouncing component is mounted. The trampoline support structure is characterized by including a joining pipe, a first annular pipe, a second annular pipe and a supporting pipe. The joining pipe is integrally formed as a linear tubular part, and is provided with a longitudinal mounting hole and two transverse mounting portions, the transverse mounting portions respectively being perpendicular to the longitudinal mounting hole and being extended in opposite directions with respect to each other for the bouncing component to be mounted. The first annular pipe is fitted to the joining pipe, as well as is provided with a first fitting segment penetrating through one of the transverse mounting portions and a first connecting segment being extended from the first fitting segment for the bouncing component to be mounted. The second annular pipe is fitted to the joining pipe, as well as is provided with a second fitting segment penetrating through the other transverse mounting portion and a second connecting segment being extended from the second fitting segment for the bouncing component to be mounted. The supporting pipe is fitted to the joining pipe and braced against a plane, as well as is provided with a third fitting segment penetrating through the longitudinal mounting hole, such that the bouncing component is mounted to the two transverse mounting portions, the first connecting segment and the second connecting segment, respectively, as well as a buffering space is formed between the bouncing component and the plane.

In one embodiment, the trampoline support structure further includes an enclosure net rod fitted to the joining pipe for a safety enclosure net to be mounted. The enclosure net rod is provided with a fixing segment penetrating through the third fitting segment of the supporting pipe, and an extending segment being extended from the fixing segment for the safety enclosure net to be mounted.

In one embodiment, the hole diameter of the longitudinal mounting hole is larger than the pipe diameter of the third fitting segment, and the pipe diameter of the third fitting segment is larger than the pipe diameter of the fixing segment.

In one embodiment, the joining pipe and the supporting pipe are further coupled and fixed together through a first fixing component, as well as the fixing segment of the enclosure net rod further includes a position-limiting groove, through which the fixing component penetrates.

In one embodiment, a second fixing component is further used to couple and fix the enclosure net rod and the supporting pipe.

In one embodiment, each of the two transverse mounting portions of the joining pipe, the first connecting segment of the first annular pipe, and the second connecting segment of the second annular pipe is provided with a first installation hole, respectively, for the bouncing component to be installed.

In one embodiment, each of the first fitting segment of the first annular pipe and the second fitting segment of the second annular pipe is provided with a second installation hole, respectively, the second installation holes and the first installation holes of the two transverse mounting portions lying on the same axis.

In one embodiment, the hole diameter of the second installation hole is larger than that of the first installation hole.

In comparison with the prior technology, there are features, obtained via the above embodiments of the present invention, as follows.

The joining pipe of the present invention is a linear tubular part, which may not only save material cost, but also simplify assembling process with enhanced efficiency of assembly. Further, a multilayered overlapped tubular structure is formed by the joining pipe, the third fitting segment and the fixing segment, so as to increase the force supporting the enclosure net rod on the joining pipe.

DETAILED DESCRIPTION OF THE PREFERRED EMBODIMENTS

Figure 1:
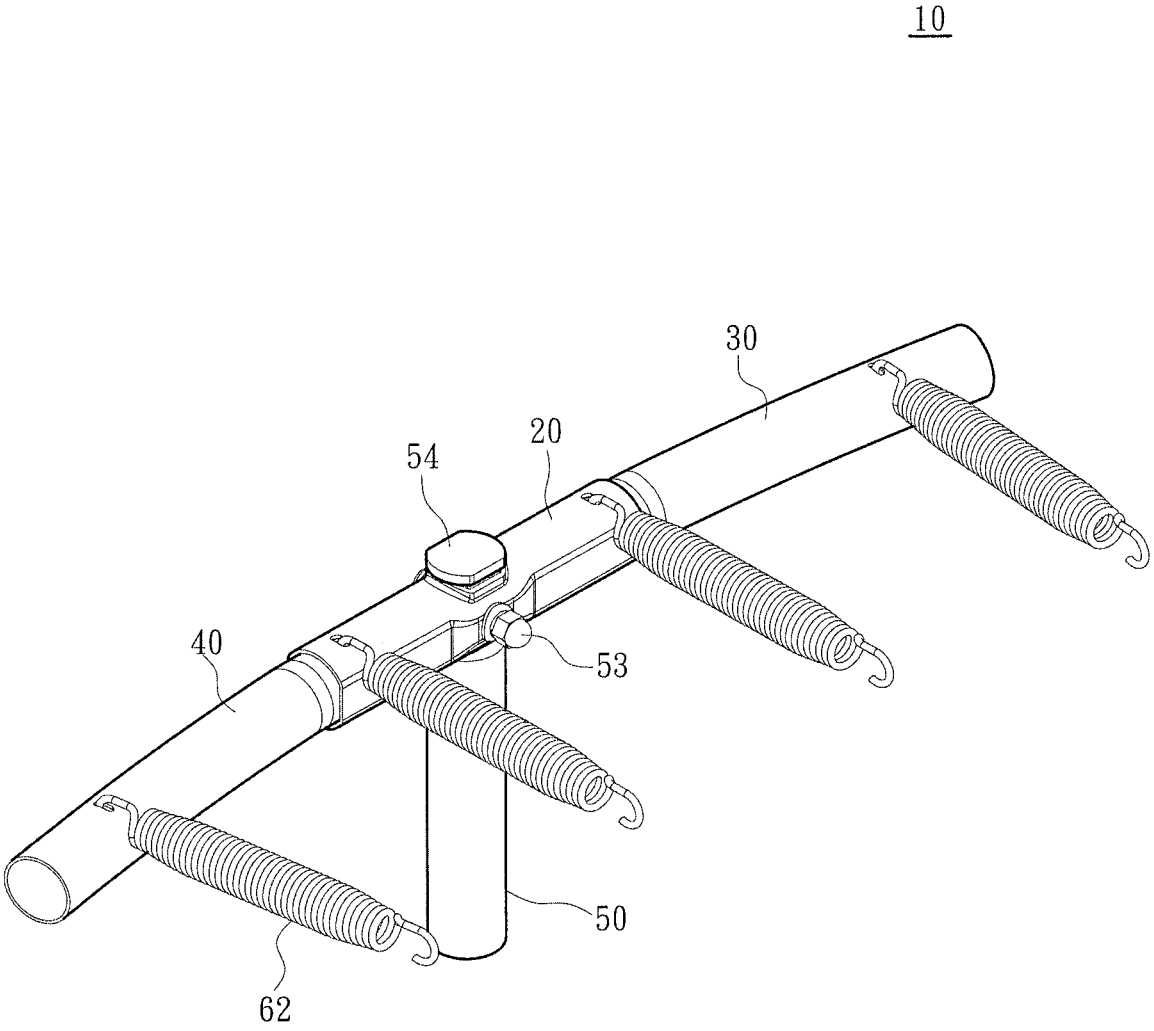
FIG. 1 is a structural diagram of a first embodiment of the present invention.

The detailed description and technical content related to the present invention is described in accompany with the drawings as follows.

As illustrated in FIG. 1, FIG. 2, FIG. 3, and FIG. 4, there is shown a first embodiment of the present invention, which provides a trampoline support structure 10, the trampoline support structure 10 including a joining pipe 20, a first annular pipe 30, a second annular pipe 40 and a supporting pipe 50. The joining pipe 20 is provided with a longitudinal mounting hole 21 and two transverse mounting portions 22, the longitudinal mounting hole 21 being located between the two transverse mounting portions 22, the two transverse mounting portions 22 respectively being perpendicular to the longitudinal mounting hole 21 and being extended in opposite directions with respect to each other, and each of the transverse mounting portions 22 being provided with a first installation hole 23. The first annular pipe 30 is fitted to the joining pipe 20, as well as is provided with a first fitting segment 31 penetrating through one of the transverse mounting portions 22 and a first connecting segment 32 being extended from the first fitting segment 31 in a direction far away from the longitudinal mounting hole 21. Moreover, the first fitting segment 31 is provided with a second installation hole 33 corresponded to the first installation hole 23. The second annular pipe 40, similarly, is fitted to the joining pipe 20, as well as is provided with a second fitting segment 41 penetrating through the other transverse mounting portion 22 and a second connecting segment 42 being extended from the second fitting segment 41 in a direction far away from the longitudinal mounting hole 21. In other words, the first connecting segment 32 and the second connecting segment 42 are allowed to extend from the longitudinal mounting hole 21 in opposite directions with respect to each other. Moreover, the second fitting segment 41 is similarly provided with a second installation hole 43 corresponded to the first installation hole 23. The supporting pipe 50, similarly, is fitted to the joining pipe 20, as well as is provided with a third fitting segment 51 penetrating through the longitudinal mounting hole 21.

In the assembling process of the trampoline support structure 10, the first fitting segment 31 of the first annular pipe 30 is firstly allowed for penetrating through one of the transverse mounting portions 22, such that the second installation hole 33 located on the first fitting segment 31 is aligned with the first installation hole 23 of the transverse mounting portion 22. Subsequently, the second fitting segment 41 of the second annular pipe 40 is allowed for penetrating through the other transverse mounting portion 22, such that the second installation hole 43 of the second fitting segment 41 is aligned with the first installation hole 23 of the transverse mounting portion 22. Finally, the third fitting segment 51 of the supporting pipe 50 is allowed for penetrating through the longitudinal mounting hole 21. Then, the assembly of the trampoline support structure 10 of the present invention is accomplished. In this embodiment, the joining pipe 20 and the supporting pipe 50 are joined and fixed together via a first fixing component 53 primarily. A first fixing hole 24 across the longitudinal mounting hole 21 is provided on the joining pipe 20, so as to enable the first fixing component 53 to join the joining pipe 20 and the supporting pipe 50 securely. Furthermore, the supporting pipe 50 is provided with a second fixing hole 52 correspondingly to the first fixing hole 24, the first fixing hole 24 and the second fixing hole 52 lying on the same axis, in such a way that the joining pipe 20 and the supporting pipe 50 are joined and fixed together by the penetration of the first fixing component 53 through the first fixing hole 24 and the second fixing hole 52.

Additionally, in this embodiment, a first blocking wall 25 projecting at the outside of the joining pipe 20 and surrounding the longitudinal mounting hole 21 as well as a second blocking wall 26 projecting at the inside of the joining pipe 20 and surrounding the longitudinal mounting hole 21 are provided on the joining pipe 20, for facilitating supporting the third fitting segment 51 via the first blocking wall 25 and the second blocking wall 26, so as to enable the supporting pipe 50 to be fitted to the joining pipe 20 firmly, when the supporting pipe 50 is fitted to the joining pipe 20 through the longitudinal mounting hole 21. In addition, in this embodiment, the trampoline support structure 10 further includes a protective cover 54, the protective cover 54 being used for covering an end of the third fitting segment 51 projecting outside of the first blocking wall 25 after penetrating through the longitudinal mounting hole 21. Thus, not only the supporting pipe 50 is closed, but also hurt caused by careless collision with the end of the third fitting segment 51 is avoided.

Figure 2:
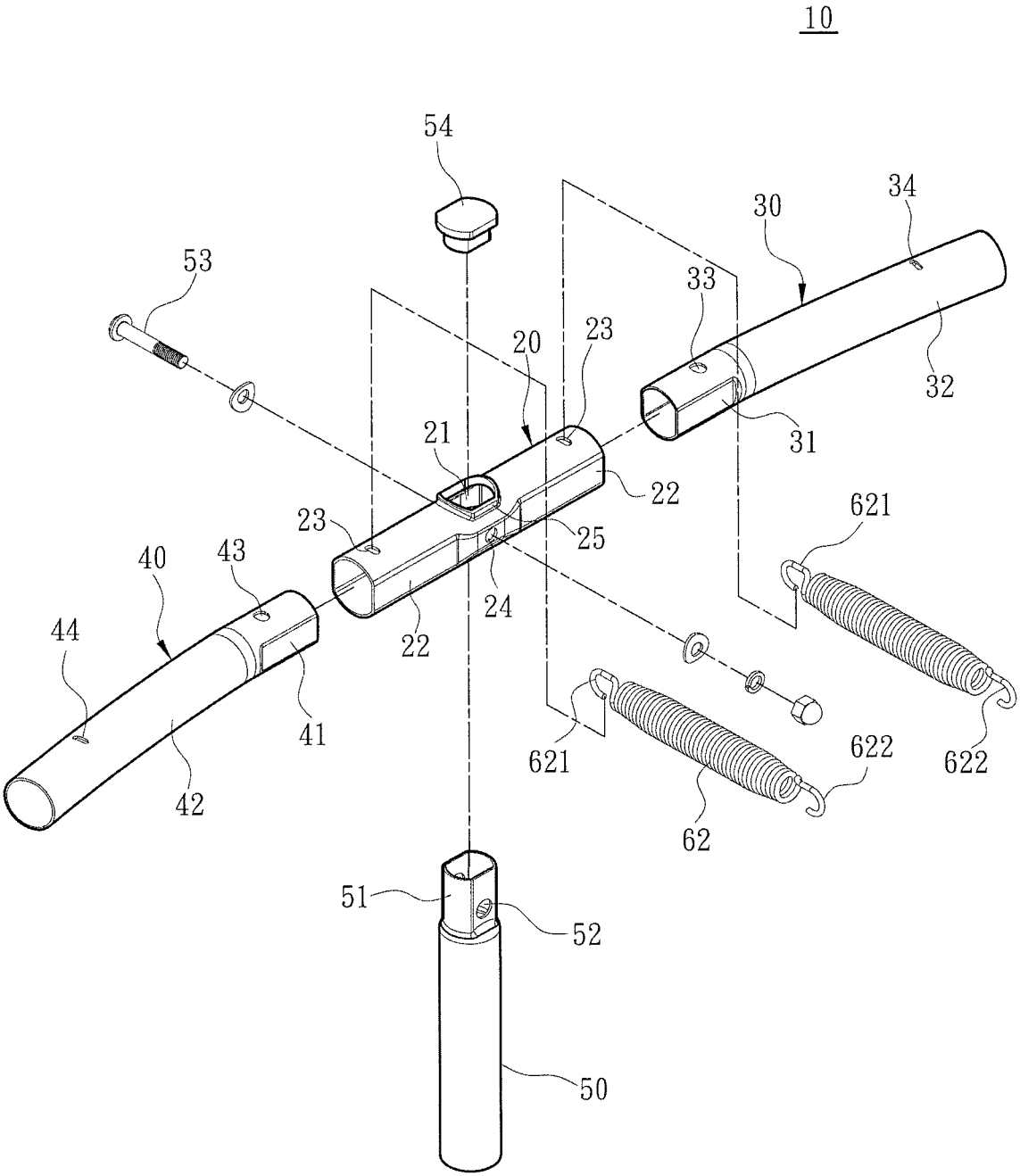
FIG. 2 is an exploded structural diagram of the first embodiment of the present invention.
Figure 3:
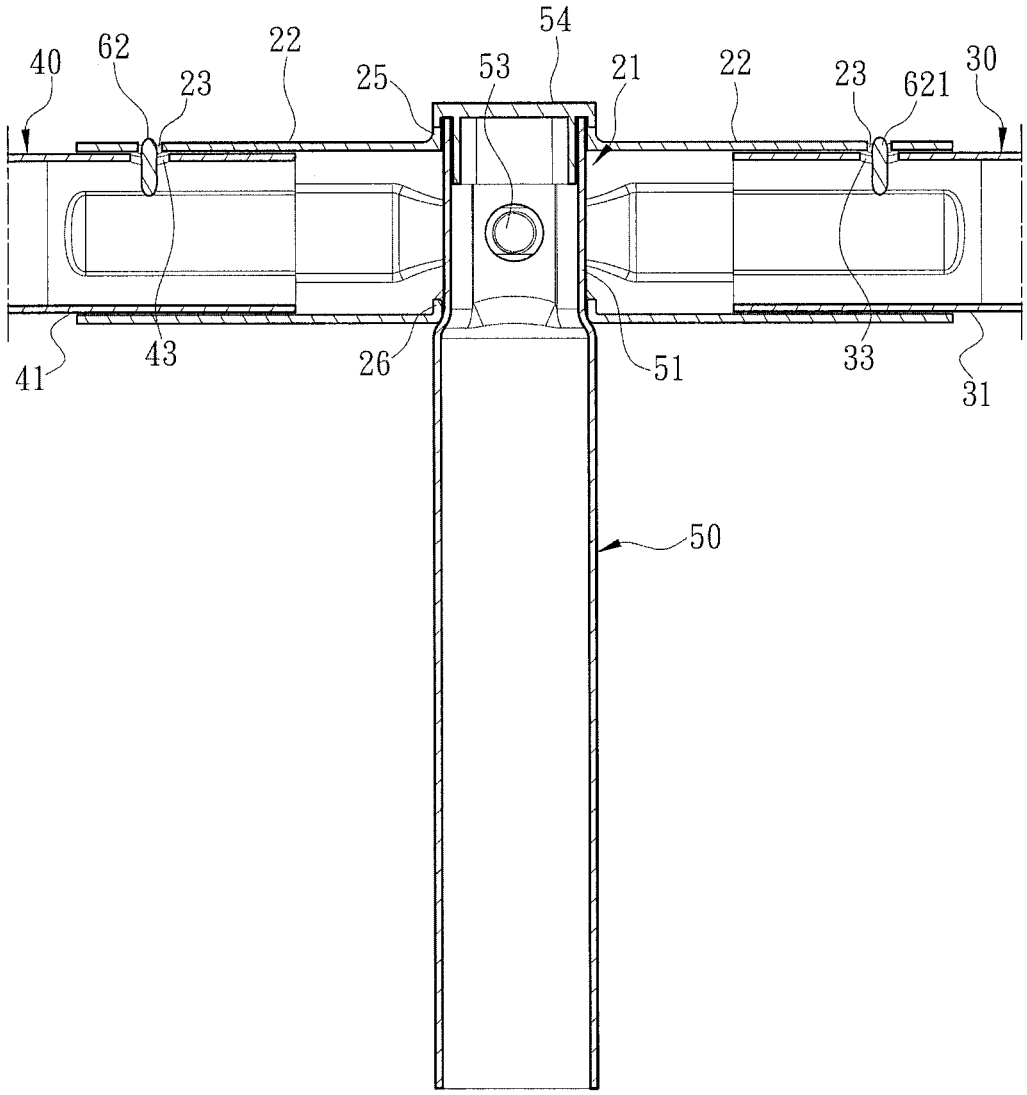
FIG. 3 is a cross-section view of the first embodiment of the present invention.

Further, as illustrated in FIG. 2, each of the pipe diameter of the first fitting segment 31 on the first annular pipe 30 and that of the second fitting segment 41 on the second annular pipe 40 is smaller than the hole diameter of each of the two transverse mounting portions 22 of the joining pipe 20. Additionally, the pipe diameter of the first connecting segment 32 is slightly larger than that of the first fitting segment 31, and the pipe diameter of the second connecting segment 42 is slightly larger than that of the second fitting segment 41. Therefore, when the first annular pipe 30 and the second annular pipe 40 are joined to the joining pipe 20, the first fitting segment 31 and the second fitting segment 41 may be used to be fitted to the two transverse mounting portions 22, respectively, such that ends of the two transverse mounting portions 22 are pressed against the first connecting segment 32 and the second connecting segment 42, respectively. On the other hand, each of the first fitting segment 31, the second fitting segment 41 and the two transverse mounting portions 22 is a square hole with fillet, such that the first fitting segment 31 and the second fitting segment 41 are incapable of rotating after penetrating through the two transverse mounting portions 22. In addition, the first annular pipe 30 is provided thereon with the first installation hole 34 being the same as that on the transverse mounting portion 22, and the second annular pipe 40 is also provided thereon with the first installation hole 44 being the same as that on the transverse mounting portion 22.

Figure 4:
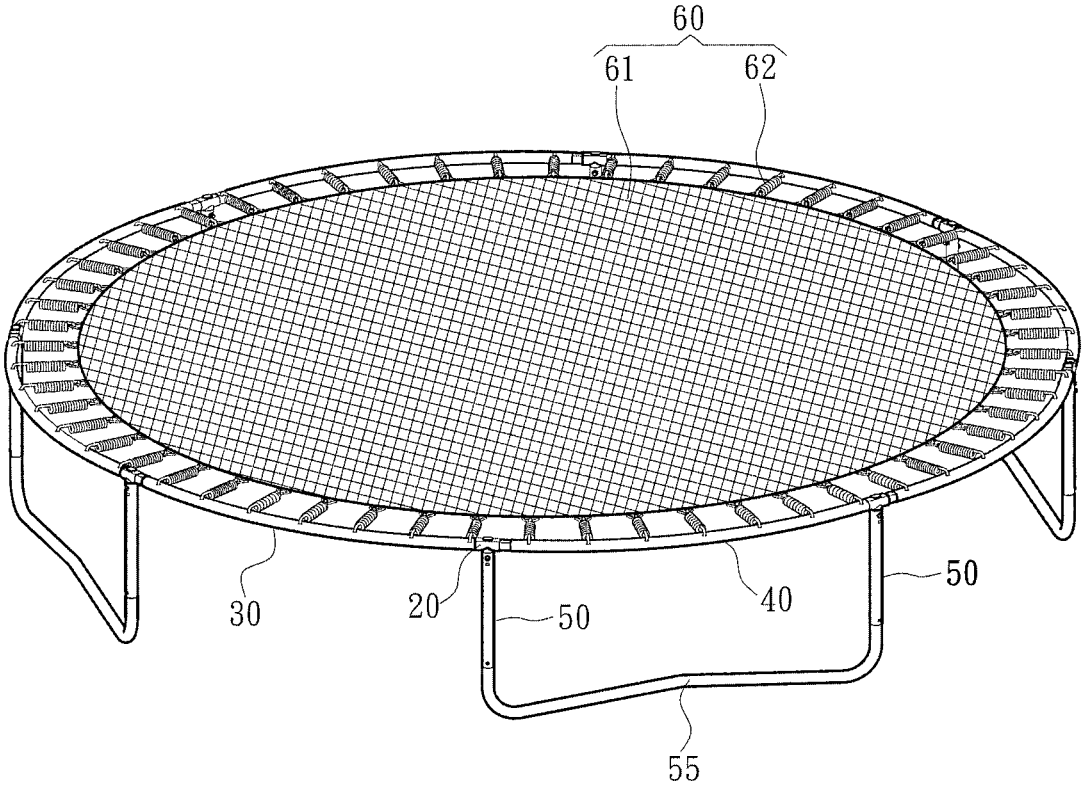
FIG. 4 is a diagram of the first embodiment of the present invention embodied on the trampoline.
Figure 5:
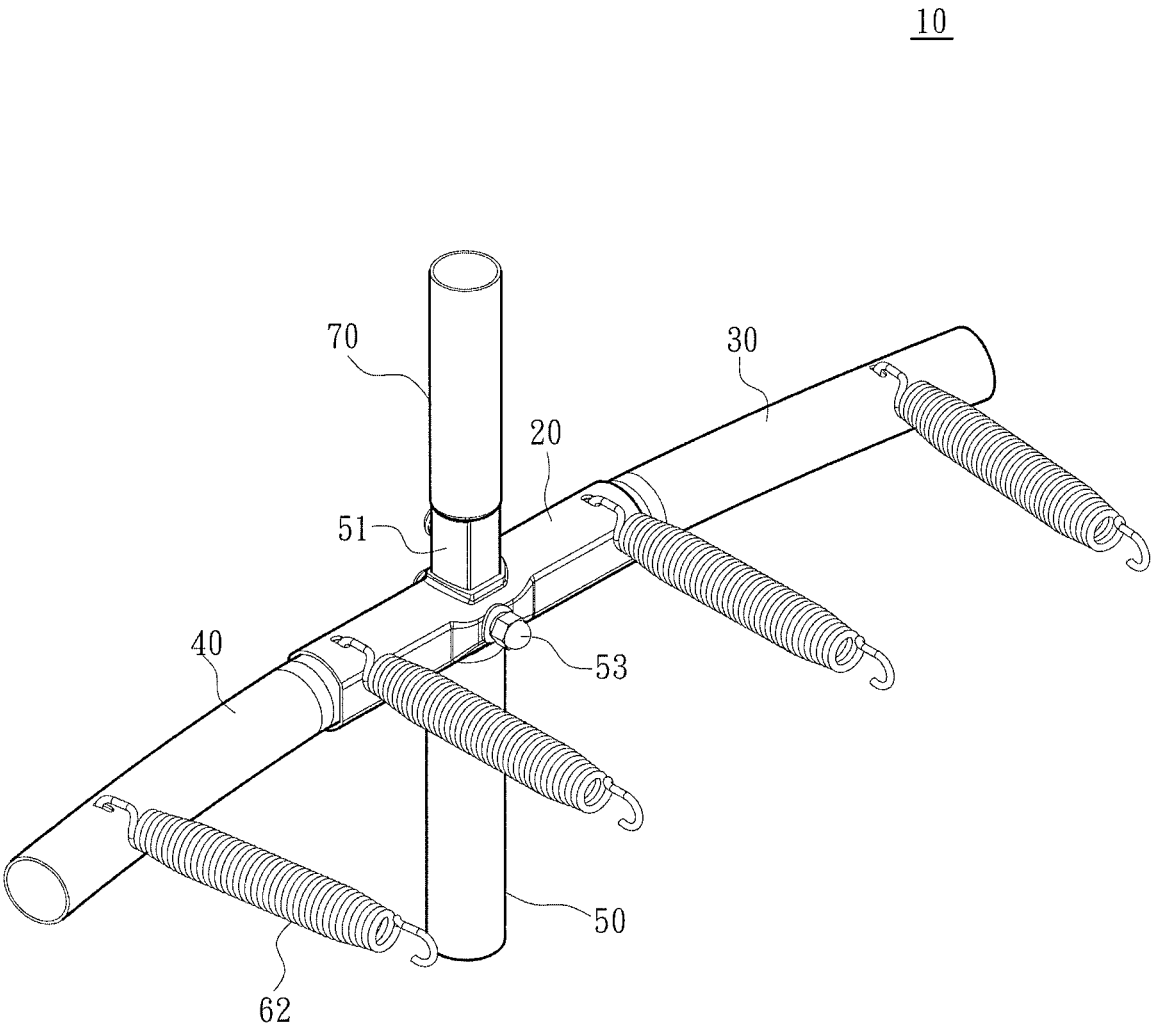
FIG. 5 is a structural diagram of a second embodiment of the present invention.
Figure 6:
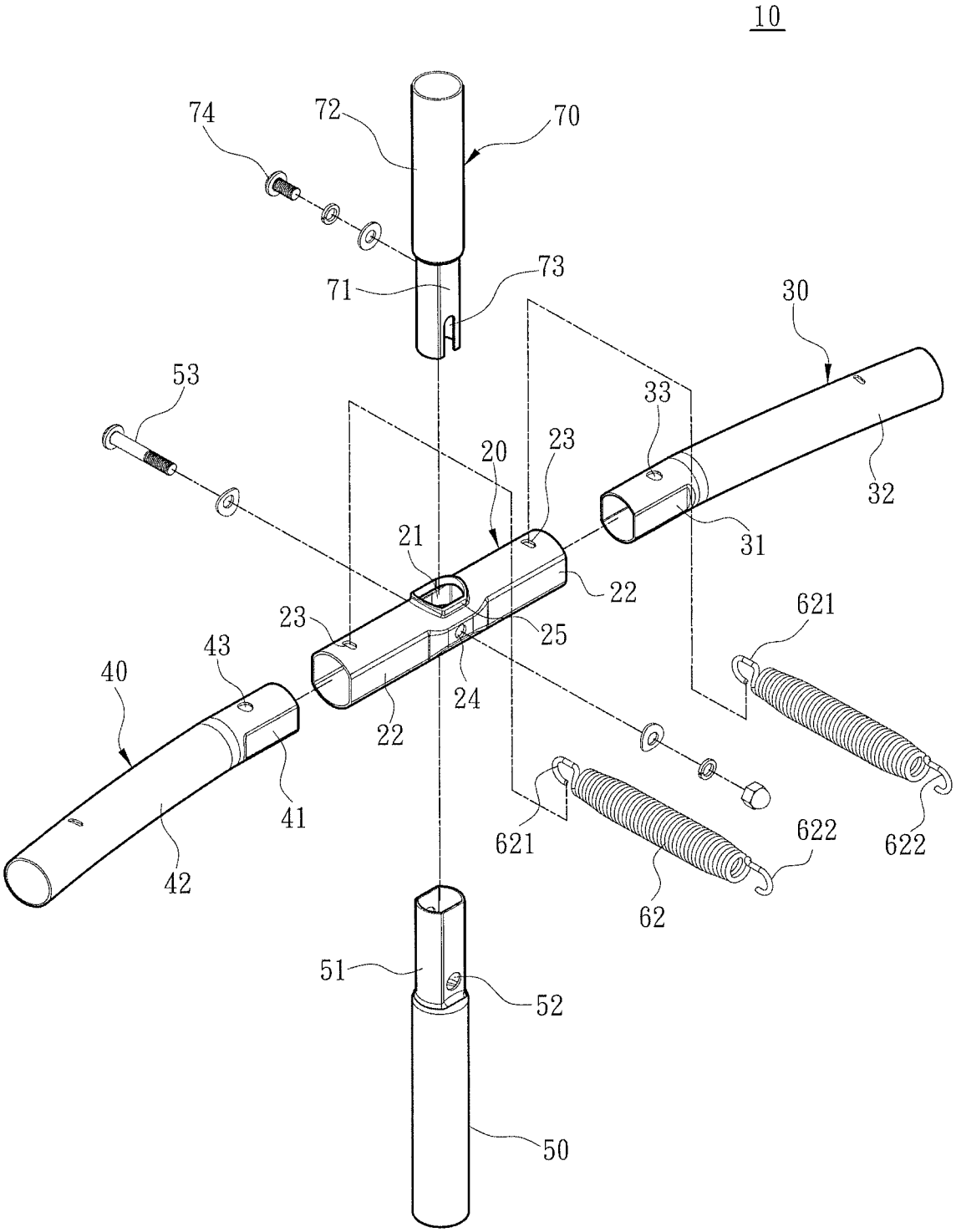
FIG. 6 is an exploded structural diagram of the second embodiment of the present invention.
Figure 7:
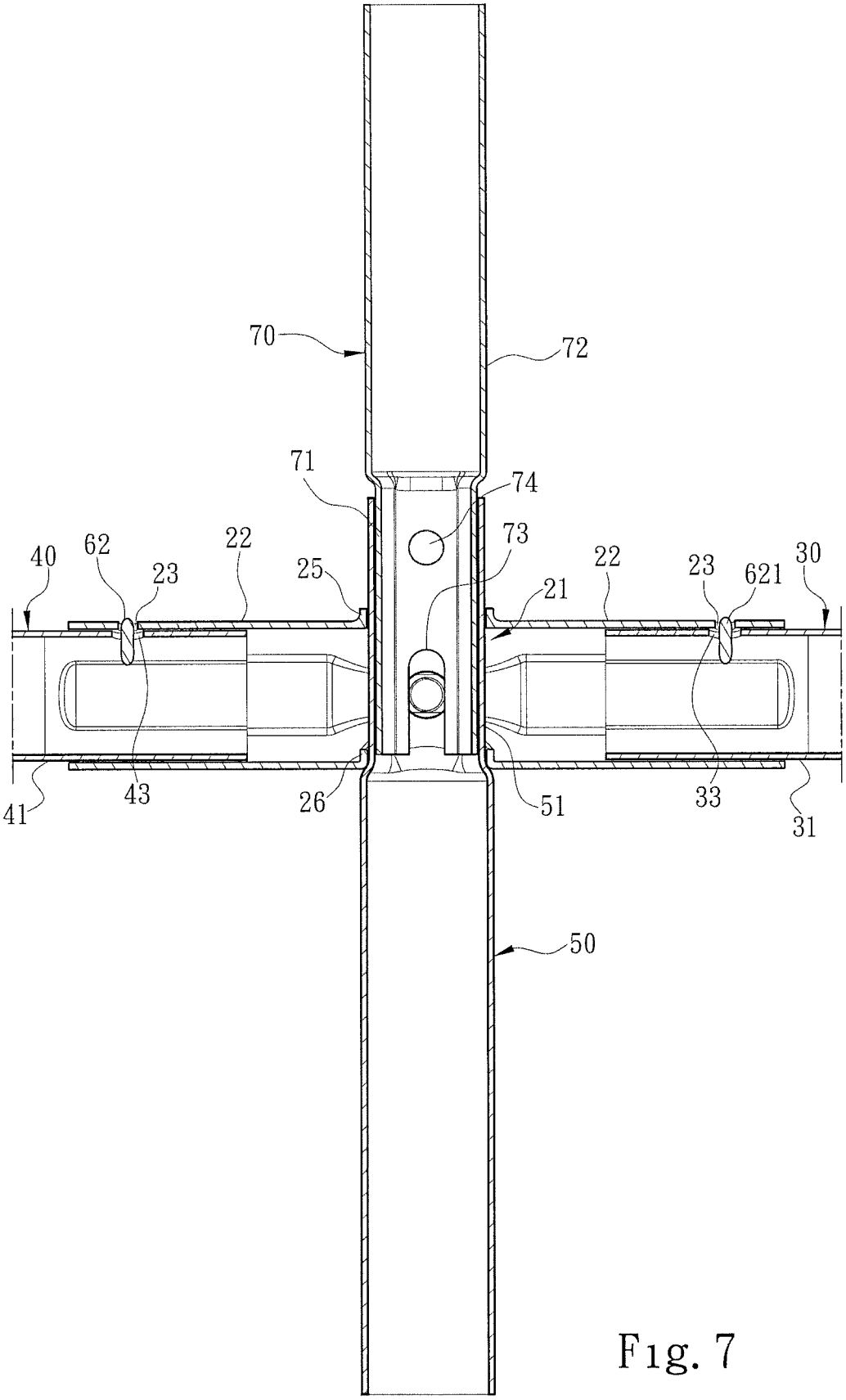
FIG. 7 is a cross-section view of the second embodiment of the present invention.
Figure 8:
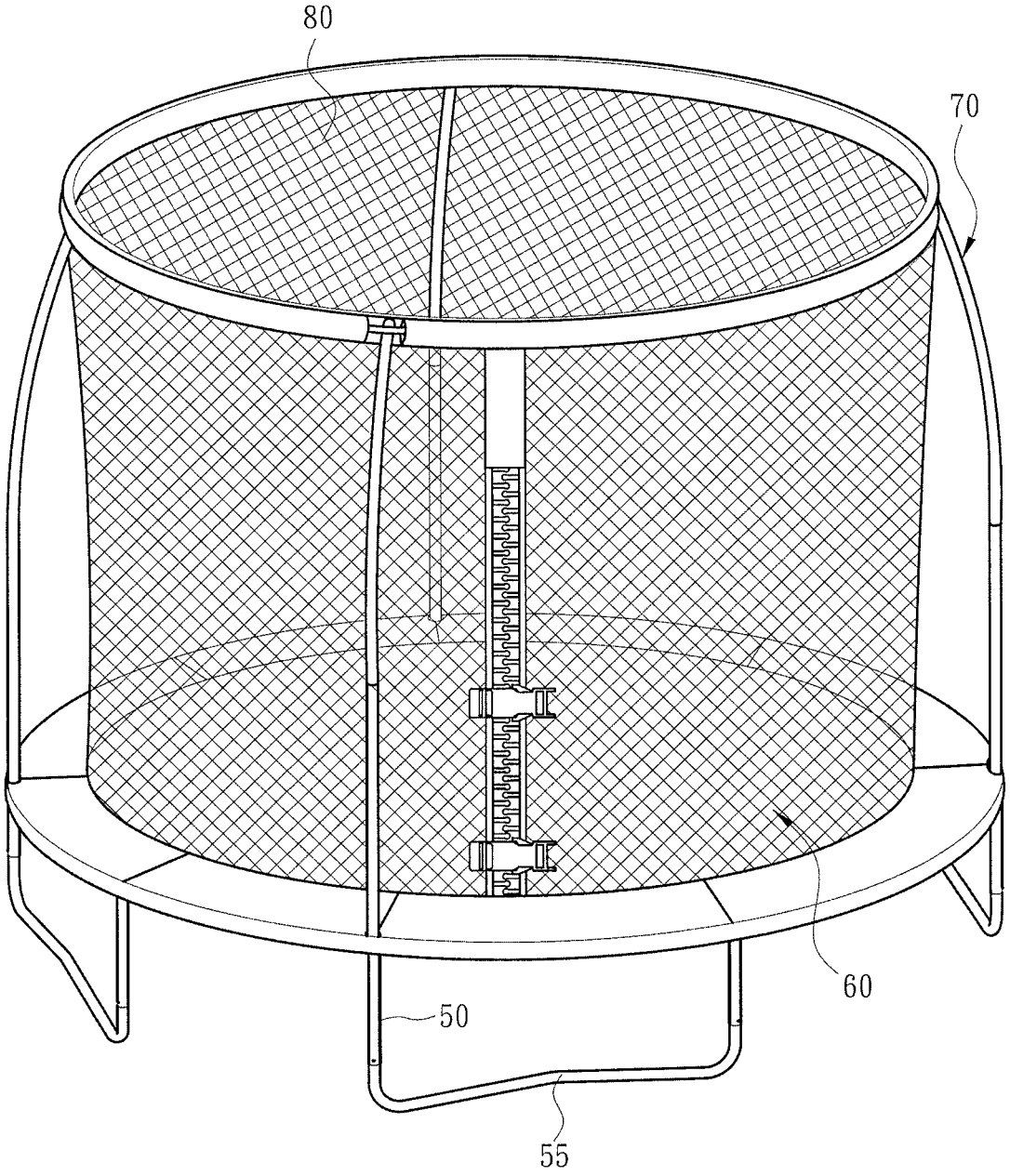
FIG. 8 is a diagram of the second embodiment of the present invention embodied on the trampoline.

Referring to FIG. 2 and FIG. 4 together, when the present invention is used for constructing a trampoline, a plurality of parts of the trampoline support structure 10 are firstly provided for constituting a trampoline frame, and then a bouncing component 60 is mounted to the trampoline frame. In detail, the first annular pipes 30 and the second annular pipes 40 are constituted as a surrounding ring via the joining pipes 20. Moreover, the bouncing component 60 is provided with a bounding surface 61 and a plurality of elastic parts 62 (such as, springs) installed on the outer rim of the bounding surface 61. In this case, the plurality of elastic parts 62 are connected and fitted to the joining pipes 20, the first annular pipes 30 and the second annular pipe 40 from the bounding surface 61, such that the bounding surface 61 is braced at the inside of the joining pipes 20, the first annular pipes 30 and the second annular pipes 40. Further, each of the plurality of elastic parts 62 is provided at each of both ends thereof with a first connecting portion 621 and a second connecting portion 622, respectively. Moreover, each of the plurality of elastic parts 62 is connected and fitted to the inside of each joining pipe 20, first annular pipe 30 or second annular pipe 40 via the first connecting portion 621, while is connected to the bounding surface 61 via the second connecting portion 622.

When each of the plurality of elastic parts 62 is fitted to the first annular pipe 30 or the second annular pipe 40, each of the plurality of elastic parts 62 is connected to the first annular pipe 30 or the second annular pipe 40 through the connection of the first connecting portion 621 to the first installation hole 34, 44. When each of the plurality of elastic part 62 is fitted to the joining pipe 20, each of the plurality of elastic part 62 is connected to the joining pipe 20 through the connection of the first connecting portion 621 to the first installation hole 23 on one of the two transverse mounting portions 22 of the joining pipe 20, the second installation hole 33 on the first fitting segment 31 of the first annular pipe 30, and the second installation hole 43 of the second fitting segment 41 of the second annular pipe 40. The first installation hole 23 and the second installation holes 33, 43 are located on the same axis, thereby several elastic parts 62 are allowed for applying tensile force to the first fitting segment 31 and the second fitting segment 41 at the same time, so as to prevent the first fitting segment 31 and the second fitting segment 41 from coming off the interior of the two transverse mounting portions 22. On the other hand, several supporting pipes 50 are braced against a plane (not shown in the figures), such that a buffering space (not shown in the figures) is formed between the bouncing component 60 and the plane. Furthermore, in this embodiment, the hole diameter of the second installation holes 33, 43 are larger than that of the first installation hole 23. Therefore, the first connecting portion 621 is capable of joining to the second installation hole 33, 43 more smoothly after penetrating through the first installation hole 23. In addition, a stand 55 may be further coupled to the bottom of two adjacent supporting pipes 50, so as to increase area of thrust surface on the bottom of the trampoline.

When a user bounces on the bounding surface 61, the plurality of elastic parts 62 are dragged by the bounding surface 61, so as to be flexibly deformed, while a supporting force is provided for the bouncing component 60 through several joining pipes 20, several first annular pipes 30 and several second annular pipes 40 so as to enable the user to bounce on the bounding surface 61 continuously. In addition, the joining pipe 20 is integrally formed, as well as the first annular pipe 30, the second annular pipe 40 and the supporting pipe 50 are all fixed to the two transverse mounting portions 22 and the longitudinal mounting hole 21 in a manner of insertion instead of welding, thereby the overall assembly strength of the trampoline support structure 10 is enhanced via the joining pipe 20.

Further, referring to FIG. 5, FIG. 6, FIG. 7, and FIG. 8, the trampoline support structure 10 in this embodiment further includes an enclosure net rod 70, as well as the third fitting segment 51 is extended out of the outside of the joining pipe 20 through the longitudinal mounting hole 21. The enclosure net rod 70 is provided with a fixing segment 71 insertedly provided inside the third fitting segment 51 and an extending segment 72 being extended from the fixing segment 71 in a direction far away from the joining pipe 20. Moreover, the fixing segment 71 is provided, at the front end thereof adjacent to the joining pipe 20, with a position-limiting groove 73. When the fixing segment 71 is insertedly provided inside the third fitting segment 51, the position-limiting groove 73 is capable of crossing the first fixing component 53, such that the fixing segment 71 may be fully inserted into the third fitting segment 51, thereby the overlapped area between the third fitting segment 51 and the fixing segment 71 may be increased. In addition, a second fixing component 74 is further used to connect the enclosure net rod 70 and the supporting pipe 50, in such a way that the enclosure net rod 70 and the supporting pipe 50 may be joined firmly. On the other hand, the hole diameter of the longitudinal mounting hole 21 is larger than the pipe diameter of the third fitting segment 51, and the pipe diameter of the third fitting segment 51 is larger than the pipe diameter of the fixing segment 71. Additionally, the third fitting segment 51 is supported by the first blocking wall 25 and the second blocking wall 26, such that a multilayered overlapped tubular structure is formed by the joining pipe 20, the third fitting segment 51 and the fixing segment 71, so as to increase the force supporting the enclosure net rod 70 on the joining pipe 20.

Therefore, a safety enclosure net 80 may be further provided on the trampoline in the present invention with the use of the enclosure net rod 70. The user is prevented from bouncing off the trampoline frame from the bounding surface 61 through the safety enclosure net 80 around the user. Thus, safety in the use of the trampoline is enhanced.

In comparison with the conventional technology, the joining pipe 20 of the present invention is a linear tubular part, which may not only save material cost, but also simplify assembling process with enhanced efficiency of assembly. Further, a multilayered overlapped tubular structure is formed by the joining pipe 20, the third fitting segment 51 and the fixing segment 71, so as to increase the force supporting the enclosure net rod 70 on the joining pipe 20.

What is claimed is:

1. A trampoline support structure used for constituting a trampoline frame, on which a bouncing component is mounted, said trampoline support structure comprising:

a joining pipe, which is a linear tubular part provided with a longitudinal mounting hole, two transverse mounting portions, and a first fixing hole, wherein said transverse mounting portions respectively are perpendicular to said longitudinal mounting hole and are extended in opposite directions with respect to each other for said bouncing component to be mounted, and said first fixing hole is across said longitudinal mounting hole;

a first annular pipe, fitted to said joining pipe, as well as provided with a first fitting segment penetrating through one of said transverse mounting portions and a first connecting segment being extended from said first fitting segment for said bouncing component to be mounted;

a second annular pipe, fitted to said joining pipe, as well as provided with a second fitting segment penetrating through the other transverse mounting portion and a second connecting segment being extended from said second fitting segment for said bouncing component to be mounted;

a supporting pipe, directly fitted to said linear tubular part and braced against a plane, as well as provided with a third fitting segment penetrating through said longitudinal mounting hole and a second fixing hole aligned with said first fixing hole; and a plurality of elastic parts, each of the plurality of the elastic parts having a first connecting portion, wherein the first connecting portion is a hook, wherein each of said two transverse mounting portions of said joining pipe is provided with a first installation hole, respectively, each of said first fitting segment of said first annular pipe and said second fitting segment of said second annular pipe is provided with a second installation hole, respectively, said second installation holes and said first installation holes of said two transverse mounting portions are aligned on the same axis, wherein each of the plurality of elastic parts is connected to the joining pipe through connection of the first connecting portion to the first installation hole on one of the two transverse mounting portions of the joining pipe and the second installation hole on the first fitting segment of the first annular pipe, or the second installation hole of the second fitting segment of the second annular pipe, a buffering space is formed between said bouncing component and said plane.

2. The trampoline support structure according to claim 1, wherein said trampoline support structure further comprises an enclosure net rod fitted to said joining pipe for a safety enclosure net to be mounted, said enclosure net rod comprising a fixing segment penetrating through said third fitting segment of said supporting pipe, and an extending segment being extended from said fixing segment for said safety enclosure net to be mounted.

3. The trampoline support structure according to claim 2, wherein said joining pipe and said supporting pipe are further coupled and fixed together by penetrating a first fixing component through said first fixing hole and said second fixing hole, as well as said fixing segment of said enclosure net rod further comprises a position-limiting groove, through which said first fixing component penetrates.

4. The trampoline support structure according to claim 3, wherein a second fixing component is further used to couple and fix said enclosure net rod and said supporting pipe.

5. The trampoline support structure according to claim 2, wherein the hole diameter of said longitudinal mounting hole is larger than the pipe diameter of said third fitting segment, and the pipe diameter of said third fitting segment is larger than the pipe diameter of said fixing segment.

6. The trampoline support structure according to claim 1, wherein each of said first connecting segment of said first annular pipe, and said second connecting segment of said second annular pipe is provided with the first installation hole, respectively, for said bouncing component to be installed.

7. The trampoline support structure according to claim 1, wherein a hole diameter of said second installation holes are larger than that of said first installation hole.

* * * * *